US008118616B1

(12) United States Patent
Clark

(10) Patent No.: US 8,118,616 B1
(45) Date of Patent: Feb. 21, 2012

(54) ELECTRICAL OUTLET ADAPTOR DEVICE

(76) Inventor: Silva L. J. Clark, Porter Ranch, CA (US)

( * ) Notice: Subject to any disclaimer, the term of this patent is extended or adjusted under 35 U.S.C. 154(b) by 147 days.

(21) Appl. No.: 12/765,634

(22) Filed: Apr. 22, 2010

(51) Int. Cl.
*H01R 33/94* (2006.01)

(52) U.S. Cl. ..... 439/640

(58) Field of Classification Search ..... 439/640, 439/650–652, 31, 173
See application file for complete search history.

(56) References Cited

U.S. PATENT DOCUMENTS

| | | | | |
|---|---|---|---|---|
| 2,305,101 | A * | 12/1942 | O'Brien | 439/4 |
| 4,583,798 | A | 4/1986 | Blazowich | |
| 5,658,152 | A * | 8/1997 | Selker | 439/31 |
| 5,727,953 | A | 3/1998 | Pashold | |
| 5,738,548 | A * | 4/1998 | Rutulante | 439/652 |
| 5,857,875 | A * | 1/1999 | Hsu et al. | 439/652 |
| 5,957,701 | A * | 9/1999 | McMillin | 439/13 |
| 6,004,138 | A * | 12/1999 | Harbertson | 439/32 |
| 6,024,588 | A * | 2/2000 | Hsu et al. | 439/173 |
| 6,068,490 | A * | 5/2000 | Salzberg | 439/25 |
| 6,196,851 | B1 * | 3/2001 | Gerard et al. | 439/21 |
| D462,056 | S | 8/2002 | Chung | |
| 6,638,074 | B1 * | 10/2003 | Fisher | 439/22 |
| 6,642,450 | B1 * | 11/2003 | Hsiao | 174/53 |
| 6,750,410 | B2 * | 6/2004 | Lee | 200/51.03 |
| 6,821,134 | B2 | 11/2004 | Chen | |
| 6,862,403 | B2 * | 3/2005 | Pedrotti et al. | 392/395 |
| 6,897,379 | B1 * | 5/2005 | Hsiao | 174/53 |
| 7,121,852 | B2 * | 10/2006 | Ng et al. | 439/131 |
| 7,214,102 | B2 | 5/2007 | Chong | |
| 7,247,028 | B2 * | 7/2007 | Schriefer | 439/11 |
| 7,347,734 | B1 * | 3/2008 | Teitelbaum | 439/652 |
| 7,374,425 | B1 * | 5/2008 | Kuo et al. | 439/31 |
| 7,435,091 | B1 | 10/2008 | Cruz | |
| 7,497,740 | B2 * | 3/2009 | Mei et al. | 439/652 |
| 7,500,854 | B2 * | 3/2009 | Gottstein | 439/13 |
| 7,625,241 | B2 * | 12/2009 | Axland et al. | 439/640 |
| 7,771,239 | B1 * | 8/2010 | Hsiao | 439/640 |
| 7,874,856 | B1 * | 1/2011 | Schriefer et al. | 439/214 |
| D636,335 | S * | 4/2011 | Clark | D13/137.2 |
| 2011/0207351 | A1 * | 8/2011 | Hsiao | 439/142 |

* cited by examiner

*Primary Examiner* — Neil Abrams

(57) ABSTRACT

An adaptor device for an electrical outlet featuring a base plug unit having standard electrical outlet components; three standard slots disposed in the front surface of the base plug unit and two standard prongs disposed in the back surface of the base plug unit, the slots and prongs are configured opposite each other in orientation; two side plugs pivotally attached to the sides of the base plug unit, each side plug having slots identical to those of the base plug unit, wherein the side plug units can pivot to a pivot angle with respect to the base plug unit.

7 Claims, 5 Drawing Sheets

ELECTRICAL OUTLET ADAPTOR DEVICE

FIELD OF THE INVENTION

The present invention is directed to an electrical outlet plug adaptor, more particularly to a plug adaptor with an upside-down plug configuration and hinged side plugs, allowing for a more convenient and versatile means of plugging of devices into the electrical outlet.

BACKGROUND OF THE INVENTION

Many individuals utilize a plurality of electrical devices on a daily basis. In some cases, electrical outlets may be scarce or the number of electrical outlets in a home or building may simply be insufficient. Many standard electrical outlets comprise two separate outlets. However, these outlets are commonly placed close together (and in the same orientation) such that if a bulky plug is inserted into one, the other becomes blocked. Power strips may be used as a means of adding additional outlets, but they can be unsightly and bulky, and become tangled in other cords or even people's feet (e.g., if used under a desk for example).

The present invention features an adaptor device for an electrical outlet that provides an alternate configuration for the electrical outlet (e.g., upside down configuration) in addition to additional outlets. Without wishing to limit the present invention to any theory or mechanism, it is believed that the adaptor device of the present invention is advantageous because is easy to use and makes the electrical outlet more versatile by allowing devices to be plugged into the outlet via a different (and move convenient) configuration. The device of the present invention also provides additional outlets for plugging in additional devices. There is no need for counter to use the device of the present invention, and the device is compact, practical, and aesthetically appealing. The device may offer larger sized outlets to accommodate chargers and other large household appliance plugs.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-5, the present invention features an adaptor device 100 for an electrical outlet that provides an alternate configuration for one of the units of the electrical outlet (e.g., upside down configuration). The device 100 of the present invention makes the electrical outlet more versatile by allowing devices to be plugged into the outlet via a different (and move convenient) configuration. For example, reversing the face of the outlet allows a device to be plugged in upside down, thereby preventing the plug from blocking the other electrical outlet of the unit. The device 100 of the present invention also provides additional outlets for plugging in additional devices.

The adaptor device 100 of the present invention comprises a base plug unit 110. The base plug unit 110 may be similar in appearance to a standard electrical outlet adaptor, which is well known to one of ordinary skill in the art. For example, such electrical outlet adaptors are commonly used by travelers in foreign countries to allow their personal electrical devices to be plugged into foreign electrical sockets. The base plug unit 110 has a front surface, a back surface, and an inner cavity, wherein standard electrical outlet components are housed in the inner cavity.

Figure 1:
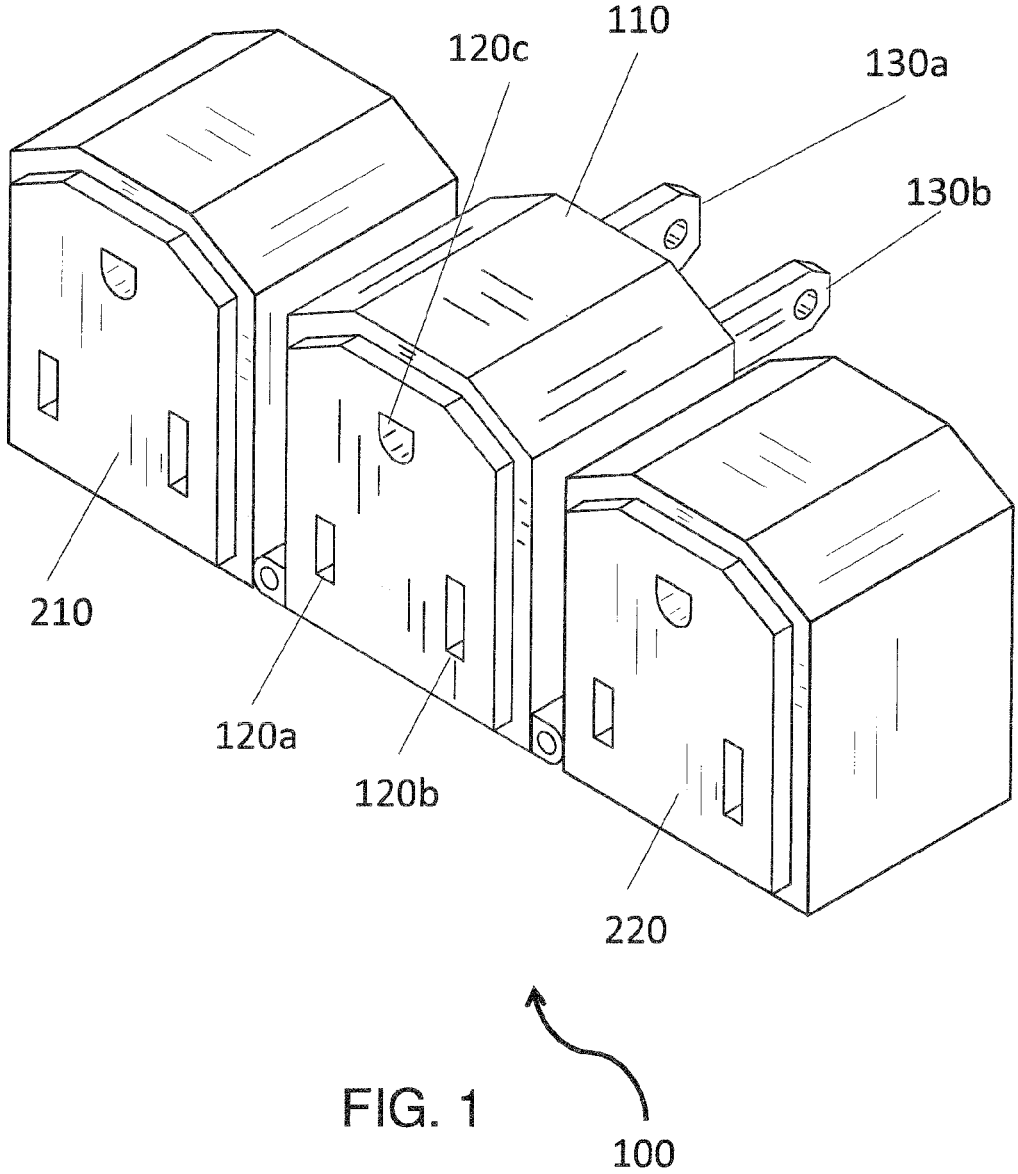
FIG. 1 is a perspective view of the adaptor device of the present invention.

Disposed in the front surface of the base plug unit 110 are a first slot 120*a*, a second slot 120*b*, and a third slot 120*c*. The slots 120 are adapted to receive the prongs of an electrical device plug. As shown in FIG. 1, the first slot 120*a* is smaller than the second slot 120*b*. The third slot 120*c* is generally rounded. The first slot 120*a* is positioned near the bottom surface and near the first side of the base plug unit 110 (e.g., a first corner). The second slot 120*b* is positioned near the bottom surface and near the second side of the base plug unit 110 (e.g., a second corner). The third slot 120*c* is positioned near the top surface of the base plug unit 110 between the first side and the second side (e.g., in the middle area).

Figure 2:
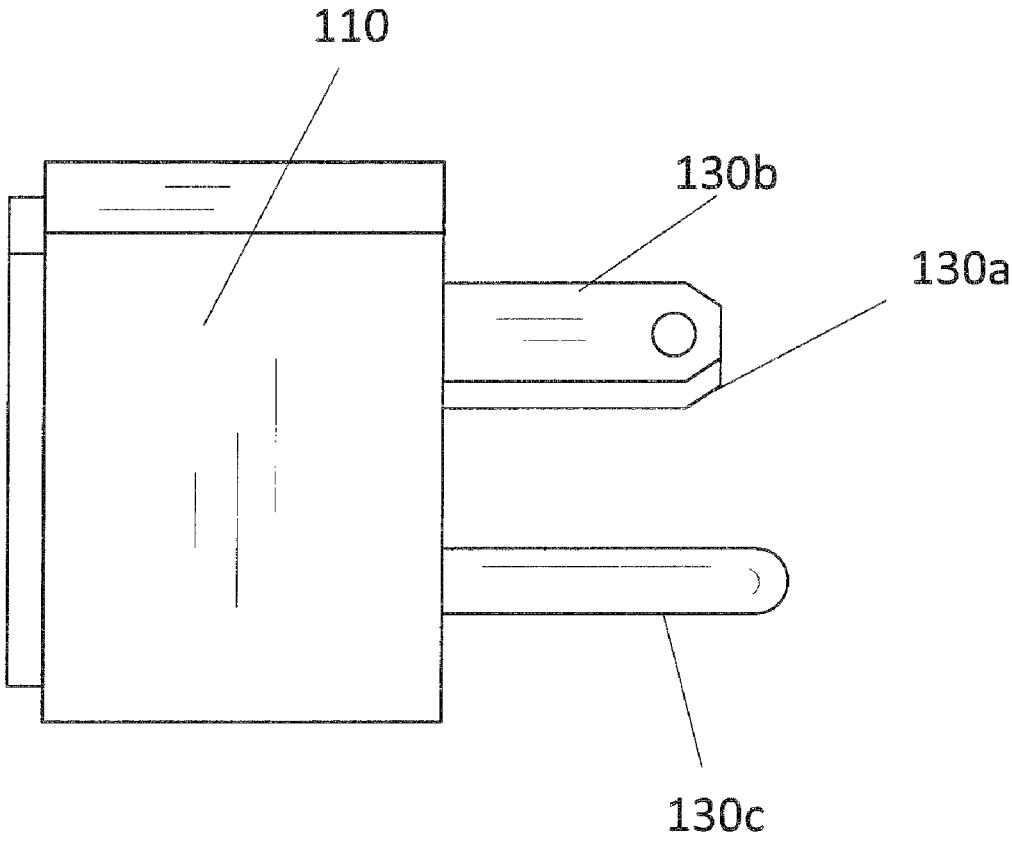
FIG. 2 is a side view of the base unit plug of the adaptor device of FIG. 1.

Disposed on the back surface of the base plug unit 110 are a first prong 130*a* and a second prong 130*b* (see FIG. 1, FIG. 2). In some embodiments, the base plug unit 110 comprises a third prong 130*c* (see FIG. 2). The third prong 130*c* may be optional since not all electrical outlets have three slots. The prongs 130 are standard electrical prongs, which are well known to one of ordinary skill in the art. The first prong 130*a* is larger than the second prong 130*b*. The third prong 130*c* is generally rounded.

The first prong 130*a* is positioned near the top surface and near the first side of the base plug unit 110. The second prong 130*b* is positioned near the top surface and near the second side of the base plug unit 110. The third prong 130*c* is positioned near the bottom surface of the base plug unit 110 between the first side and the second side (e.g., in the middle area). The configuration with the slots 120 of the base plug unit 110 being opposite that of the prongs 130 effectively reverses the orientation of the electrical socket 101 that the device 100 is plugged into (e.g., see FIG. 5).

A first side plug unit 210 is pivotally attached to the first side of the base plug unit 110 via a first pivot component. A second side plug unit 220 is pivotally attached to the second side of the base plug unit 110 via a second pivot component. The side plug units 210, 220 are similar to the base plug unit 110, for example the side plug units 210, 220 each comprise the set of slots 120. However, the side plug units 210, 220 lack the prongs 130. The side plug units 210, 220 are operatively connected to the base plug unit 110 so as to draw power. This operative connection is similar to that of extension cords and other electrical adaptors with multiple outlet sockets, which are well known to one of ordinary skill in the art.

The pivot components of the side plug units 210, 220 allow the side plug units 210, 220 to be operatively connected to the base plug unit 110 (e.g., electrical connection components travel through the pivot components). The pivot components (e.g., hinge components) may be coated and/or insulated for protection. Such electrical connections are well known by one of ordinary skill in the art.

Figure 3:
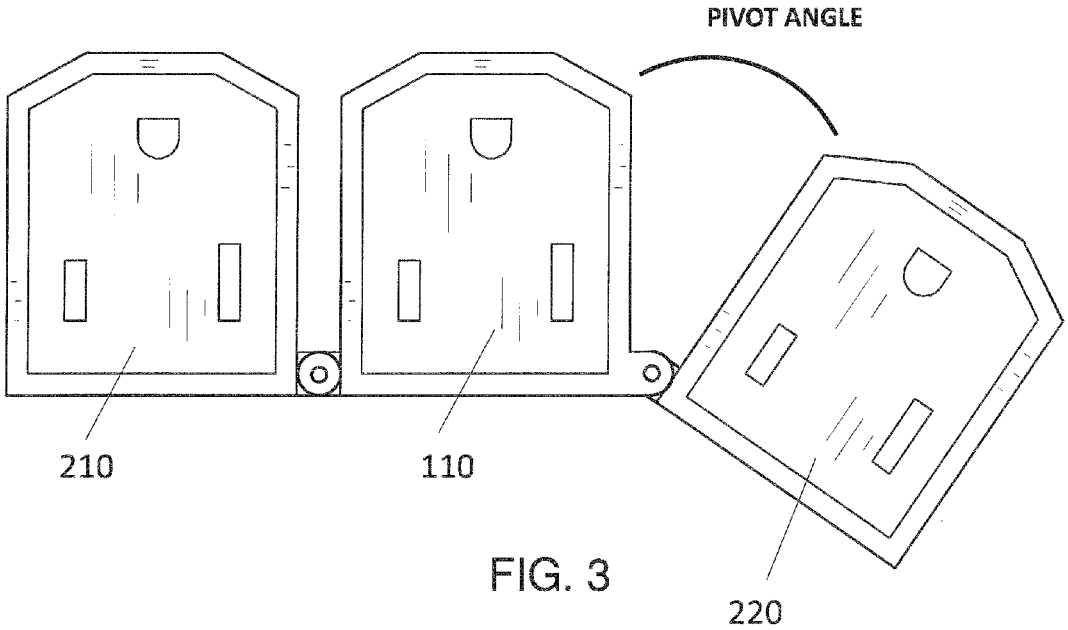
FIG. 3 is a front view of the adaptor device of FIG. 1.
Figure 4:
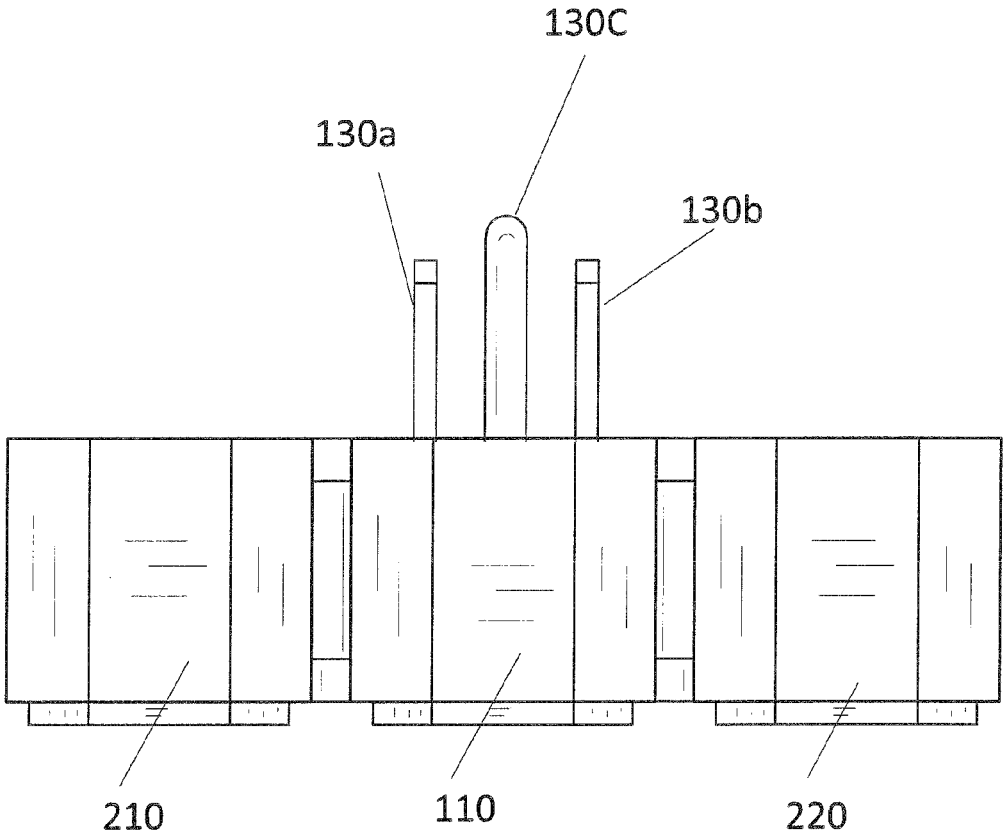
FIG. 4 is a top view of the adaptor device of FIG. 1.
Figure 5:
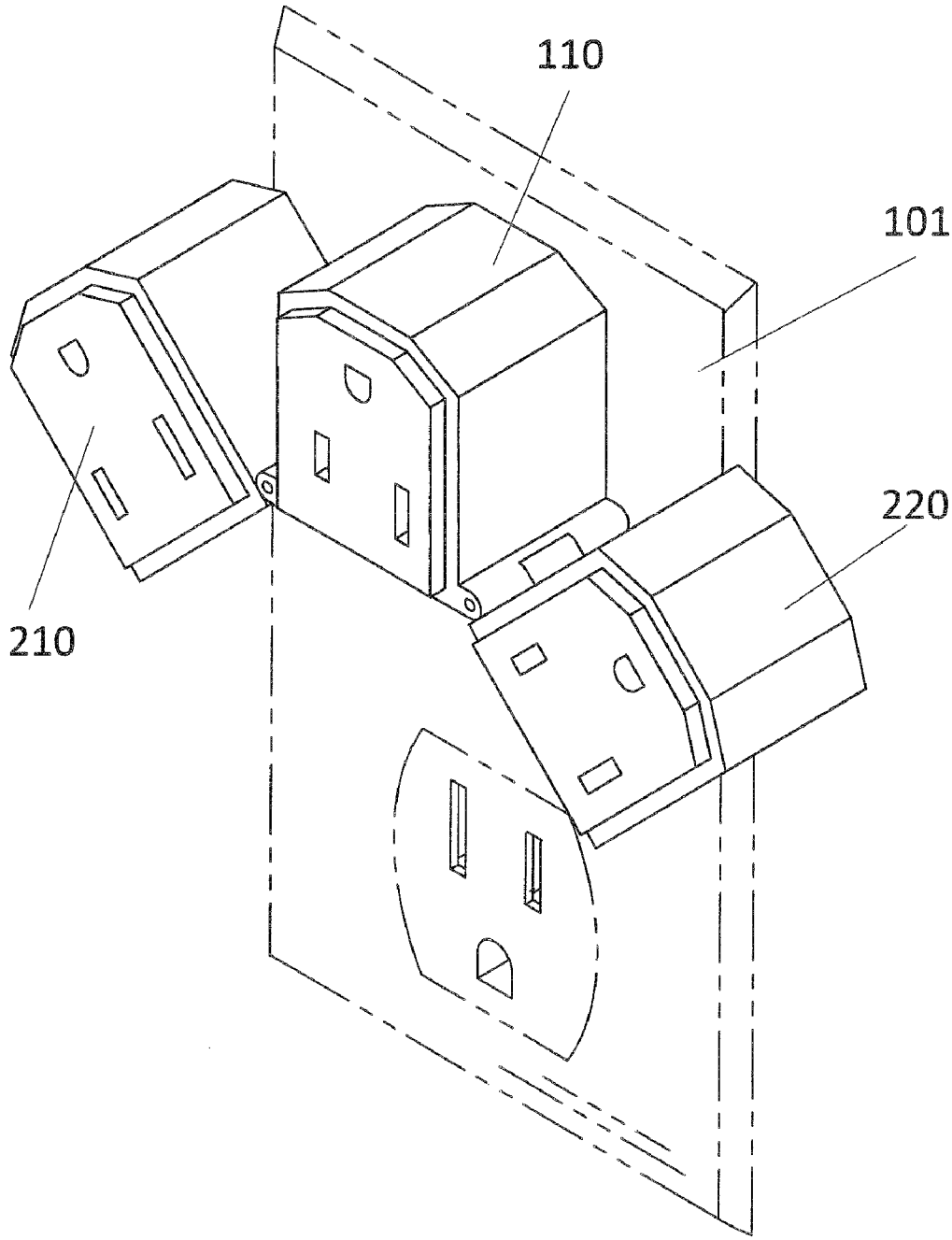
FIG. 5 is an in-use view of the adaptor device of FIG. 1.

Referring now to FIG. 3, the side plug units 210, 220 can pivot with respect to the base plug unit 110. This can help the side plug units 210, 200 accommodate electrical devices in some cases. In some embodiments, the pivot angle (e.g., angle between the side plug unit and the base plug unit 110) is between about 0 to 30 degrees. In some embodiments, the pivot angle is between about 0 to 60 degrees. In some embodiments, the pivot angle is between about 0 to 90 degrees. In some embodiments, the pivot angle is more than about 90 degrees.

The device 100 of the present invention may be constructed from a variety of materials (e.g., durable plastic, metal) and in a variety of sizes. For example, in some embodiments, the base plug unit 110 is between about 1 to 2 inches in width, e.g., 1.5 inches, as measured from the first side to the second side. In some embodiments, the base plug unit is more than about 2 inches in width. In some embodiments, the base plug unit 110 is between about 1 to 2 inches in length, e.g., 1 inch, as measured from the front surface to the back surface. In some embodiments, the base plug unit 110 is more than about 2 inches in length. In some embodiments, the base plug unit 110 is between about 1 to 2 inches in height, e.g., 1.75 inches, as measured from the bottom surface to the top surface. In some embodiments, the base plug unit 110 is more than about 2 inches in height.

The base plug unit 110 may be constructed in a variety of shapes, for example generally rectangular (e.g., square), rounded, circular, oval, irregular in shape, and/or the like. The present invention is not limited to the aforementioned shapes or the shapes shown in the figures.

In some embodiments, the present invention features an adaptor device 100 comprising only the base plug unit 110. In some embodiments, the adaptor device 100 of the present invention comprises surge suppressors (e.g., like surge protector power strips).

As used herein, the term "about" refers to plus or minus 10% of the referenced number. For example, an embodiment wherein the base plug unit 110 is about 2 inches in height includes a base plug unit that is between 1.8 and 2.2 inches in height.

The following disclosures of the following U.S. Patents are incorporated in their entirety by reference herein: U.S. Pat. No. 6,821,134; U.S. Pat. No. 6,750,410; U.S. Pat. No. 4,583,798; U.S. Pat. No. 7,435,091; U.S. Pat. No. 7,214,102; U.S. Pat. No. 5,727,953.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An adaptor device for an electrical outlet, said adaptor device comprising:

(a) a base plug unit having a front surface, a back surface, and an inner cavity, wherein standard electrical outlet components are housed in the inner cavity;

(b) a first slot, a second slot, and a third slot each disposed in the front surface of the base plug unit, the slots are each adapted to receive a prong of an electrical device plug, wherein the first slot is smaller than the second slot, the first slot is positioned near a bottom surface and a first side of the base plug unit, the second slot is positioned near the bottom surface and a second side of the base plug unit, and the third slot is positioned near a top surface of the base plug unit between the first side and the second side;

(c) a first prong and a second prong disposed on the back surface of the base plug unit, the prongs are standard electrical prongs, the first prong is larger than the second prong, wherein the first prong is positioned near the top surface and the first side of the base plug unit and the second prong is positioned near the top surface and the second side of the base plug unit; and (d) a first side plug unit pivotally attached to the first side of the base plug unit via a first pivot component and a second side plug unit pivotally attached to the second side of the base plug unit via a second pivot component, the side plug units each comprise a set of slots identical to those of the base plug unit, the side plug units are operatively connected to the base plug unit via standard electrical connections connecting through the respective pivot components, wherein the side plug units can pivot to a pivot angle with respect to the base plug unit.

2. The adaptor device of claim 1, wherein the base plug unit is constructed in a generally rectangular shape, rounded shape, circular shape, or oval, shape.

3. The adaptor device of claim 1, wherein the pivot angle is between about 0 to 30 degrees.

4. The adaptor device of claim 1, wherein the pivot angle is between about 0 to 60 degrees.

5. The adaptor device of claim 1, wherein the pivot angle is between about 0 to 90 degrees.

6. The adaptor device of claim 1, wherein the pivot components are coated or insulated.

7. The adaptor device of claim 1, wherein the base plug unit further comprises a generally rounded third prong positioned near the bottom surface of the base plug unit between the first side and the second side of the base plug unit.

* * * * *